US008606163B2

(12) United States Patent
Yamamoto et al.

(10) Patent No.: US 8,606,163 B2
(45) Date of Patent: Dec. 10, 2013

(54) FIXING DEVICE AND IMAGE FORMING APPARATUS

(75) Inventors: Naoki Yamamoto, Toyohashi (JP); Mamoru Fukaya, Nagoya (JP); Noboru Yonekawa, Toyohashi (JP); Toru Hayase, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 253 days.

(21) Appl. No.: 13/113,719

(22) Filed: May 23, 2011

(65) Prior Publication Data

US 2011/0299903 A1 Dec. 8, 2011

(30) Foreign Application Priority Data

Jun. 2, 2010 (JP) ..... 2010-126890

(51) Int. Cl.
*G03G 15/00* (2006.01)
*G03G 15/20* (2006.01)

(52) U.S. Cl.
CPC ..... *G03G 15/20* (2013.01)
USPC ..... 399/329; 399/69; 399/90; 399/322

(58) Field of Classification Search
USPC ..... 399/33, 67, 69, 90, 122, 320–322, 399/328–331; 219/216, 469, 543, 544
See application file for complete search history.

(56) References Cited

U.S. PATENT DOCUMENTS 5,349,423 A * 9/1994 Nagato et al. ..... 399/122
2007/0223978 A1* 9/2007 Ishii et al. ..... 399/329
2009/0169231 A1 7/2009 Asakura et al.

FOREIGN PATENT DOCUMENTS

JP 2003-323066 11/2003
JP 2007-272223 10/2007
JP 2009-157108 7/2009

OTHER PUBLICATIONS

Notification of Reasons for Refusal mailed Apr. 17, 2012, directed to Japanese Application No. 2010-126890; 5 pages.

* cited by examiner

*Primary Examiner* — Walter L Lindsay, Jr.
*Assistant Examiner* — Jessica L Eley
(74) *Attorney, Agent, or Firm* — Morrison & Foerster LLP

(57) ABSTRACT

Disclosed is a fixing device for thermally fixing an unfixed image onto the recording sheet, the fixing device comprising: a fixing belt; and a meander regulation member provided adjacent to an edge of the fixing belt in a width direction thereof, and operable to prevent meandering of the fixing belt, wherein the fixing belt includes: a resistive heat layer that is tubular and generates heat when an electric current is applied thereto; and first and second electrodes that are provided circumferentially on an outer circumferential surface of the resistive heat layer, and that receive and apply the electric current to the resistive heat layer, and the first electrode is provided closer to the meander regulation member than to the second electrode, and is at a distance from the edge of the fixing belt in the width direction thereof.

14 Claims, 5 Drawing Sheets

FIXING DEVICE AND IMAGE FORMING APPARATUS

This application is based on application No. 2010-126890 filed in Japan, the contents of which are hereby incorporated by reference.

BACKGROUND OF THE INVENTION (1) Field of the Invention

The present invention relates to a fixing device and an image forming apparatus, and in particular to a technique for preventing an electrode from peeling off from a resistive heater in a fixing device that fuses a toner image onto a recording sheet by Joule heat generated by applying an electric current to the resistive heater.

(2) Related Art

Conventionally, a structure that is widely used in fixing devices is to fuse a toner image onto a recording sheet by heating the toner image with use of a ceramic heater. In this structure, a fixing belt, which is endless and wound around a fixing roller, is pressed against a pressure roller and driven to rotate. When the recording sheet passes through between the fixing belt and the pressure roller, the toner image, which is heated with use of the ceramic heater, is fused onto the recording sheet.

However, there is always a demand for further shortening warm-up time required for raising a fixing belt to a fixing temperature and further reducing power consumption. To meet this demand, a structure is proposed to provide a resistive heater for a fixing belt, and to apply an electric current to the resistive heater to generate Joule heat. In this way, a toner image is fixed by the Joule heat. According to this structure, it is possible to shorten the warm-up time and save power consumption.

In a case where the aforementioned structure is employed for a fixing device, a fixing belt is rotatably wound around a fixing roller to reduce a contact area between the fixing belt and the fixing roller. This helps prevent heat from escaping from the fixing belt to the fixing roller, thus shortening the warm-up time. However, winding the fixing belt in such a manner may cause the fixing belt to meander with respect to the fixing roller. To address this problem, a meander regulation plate for regulating the meandering of the fixing belt is provided for each side of the fixing belt, such that each of the meander regulation plates makes contact with a respective edge of the fixing belt in a direction of a rotation axis thereof.

However, in order to apply an electric current to the resistive heater, the fixing belt includes electrodes which are each provided circumferentially at a respective end of the fixing belt in a direction of the rotation axis. Therefore, when the fixing belt meanders, the electrodes are subjected to a stress by sliding against the meander regulation plates, and peel off from the resistive heater. When the electrodes peel off from the resistive heater, not only is the fixing belt damaged, but smoking or firing may occur due to variations in current density in the resistive heater, discharge at the peeled portion of the electrodes, etc.

SUMMARY OF THE INVENTION

The present invention has been achieved in view of the above problem, and an aim thereof is to provide a fixing device in which a fixing belt is rotatably wound around a fixing roller, the fixing belt having an electrode that is for supplying an electric current to a resistive heater, and that resists peeling off from the resistive heater, and an image forming apparatus including the fixing device.

In order to solve the above problem, the present invention provides a fixing device for causing a recording sheet, on which an unfixed image has been formed, to pass through a fixing nip, and thermally fixing the unfixed image onto the recording sheet, the fixing device comprising: a fixing belt that is endless; a first pressing member provided inside a closed rotation path of the fixing belt; a second pressing member operable to press the first pressing member from outside the closed rotation path so as to form the fixing nip; and a meander regulation member provided adjacent to an edge of the fixing belt in a width direction thereof, and operable to prevent meandering of the fixing belt, wherein the fixing belt includes: a resistive heat layer that is tubular and generates heat when an electric current is applied thereto; and first and second electrodes that are provided circumferentially on an outer circumferential surface of the resistive heat layer, and that receive and apply the electric current to the resistive heat layer, and the first electrode is provided closer to the meander regulation member than to the second electrode, and is at a distance from the edge of the fixing belt in the width direction thereof.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF PREFERRED EMBODIMENTS

The following describes an embodiment of a fixing device and an image forming apparatus according to the present invention, with reference to the drawings.

1. Structure of Image Forming Apparatus

First, descriptions are provided of a structure of an image forming apparatus according to the embodiment.

Figure 1:
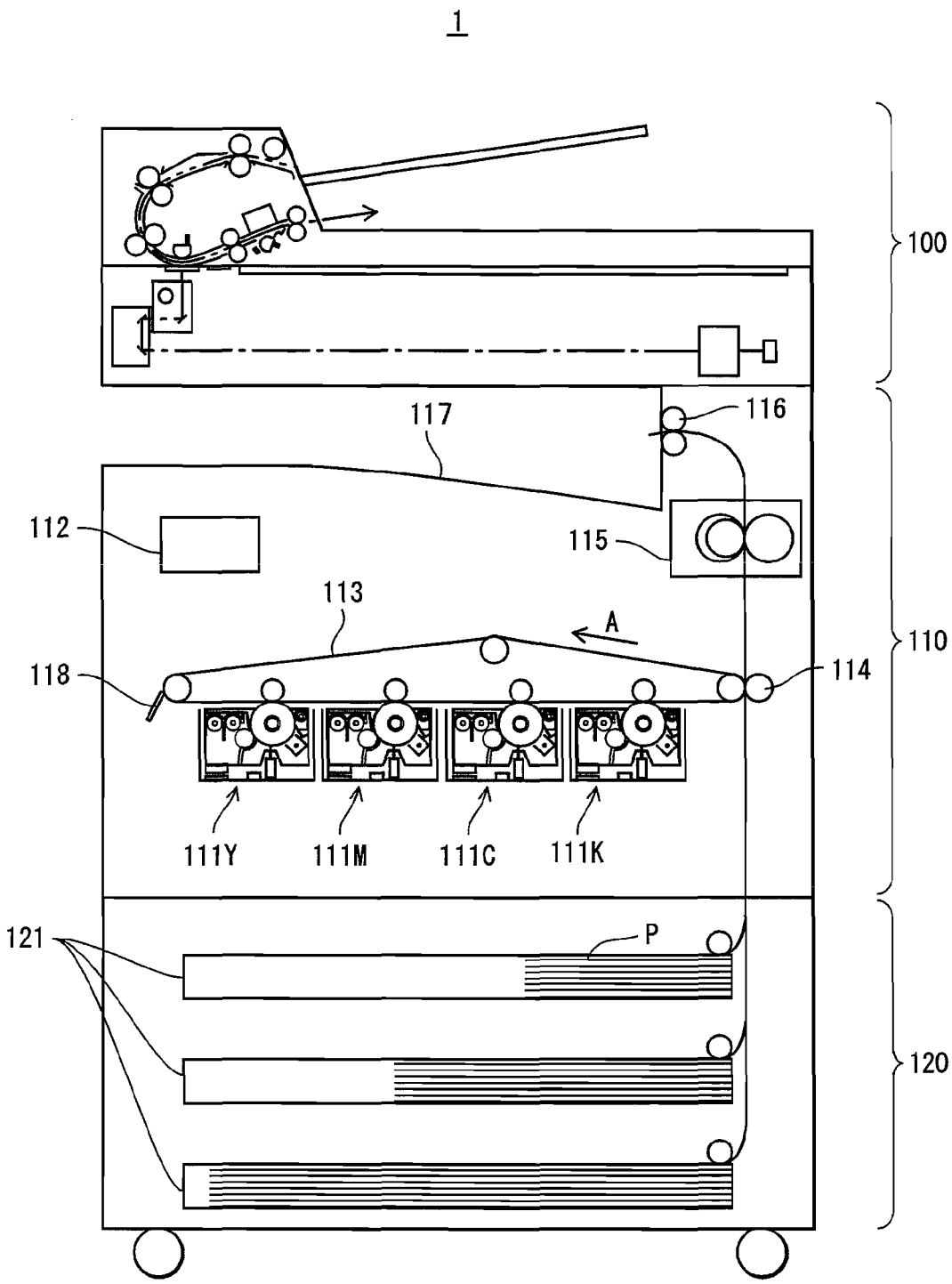
FIG. 1 shows a main structure of an image forming apparatus according to an embodiment of the present invention.

FIG. 1 shows a main structure of the image forming apparatus according to the embodiment. As shown in FIG. 1, an image forming apparatus 1 includes a document reader 100, an image former 110, and a paper feeder 120. The document reader 100 generates image data by optically reading a document.

The image former 110 includes imaging members 111Y to 111K, a controller 112, an intermediate transfer belt 113, a secondary transfer roller pair 114, a fixing device 115, an ejection roller 116, an ejection tray 117, and a cleaner 118.

The imaging members 111Y to 111K respectively form toner images of yellow (Y), magenta (M), cyan (C) and black (K) by the control of the controller 112, and electrostatically transfer (i.e., primarily transfer) the toner images onto the intermediate transfer belt 113 such that the toner images are superimposed at the same position. The intermediate transfer belt 113 is an endless belt that rotates in a direction of an arrow A so as to convey the toner images to a secondary transfer position.

The paper feeder 120 includes paper feed cassettes 121, each containing recording paper P of a different size, and supplies the recording paper P to the image former 110. After supplied to the image former 110, the recording paper P is conveyed to the secondary transfer position. In the meanwhile, the intermediate transfer belt 113 conveys the toner images.

The secondary transfer roller pair 114 is composed of a pair of rollers having a different potential and being pressed against each other to form a transfer nip. The transfer nip electrostatically transfers (i.e., secondarily transfers) the toner images on the intermediate transfer belt 113 to the recording paper P. The recording paper P, to which the toner images have been transferred, is conveyed to the fixing device 115.

The fixing device 115 employs an electromagnetic induction heating method. The fixing device 115 presses the toner images against the recording paper P after heating and fusing the toner images. The recording paper P, on which the toner images have been fused, is ejected onto the ejection tray 117 by the ejection roller 116.

2. Structure of Fixing Device 115

Next, descriptions are provided of a structure of the fixing device 115.

Figure 2:
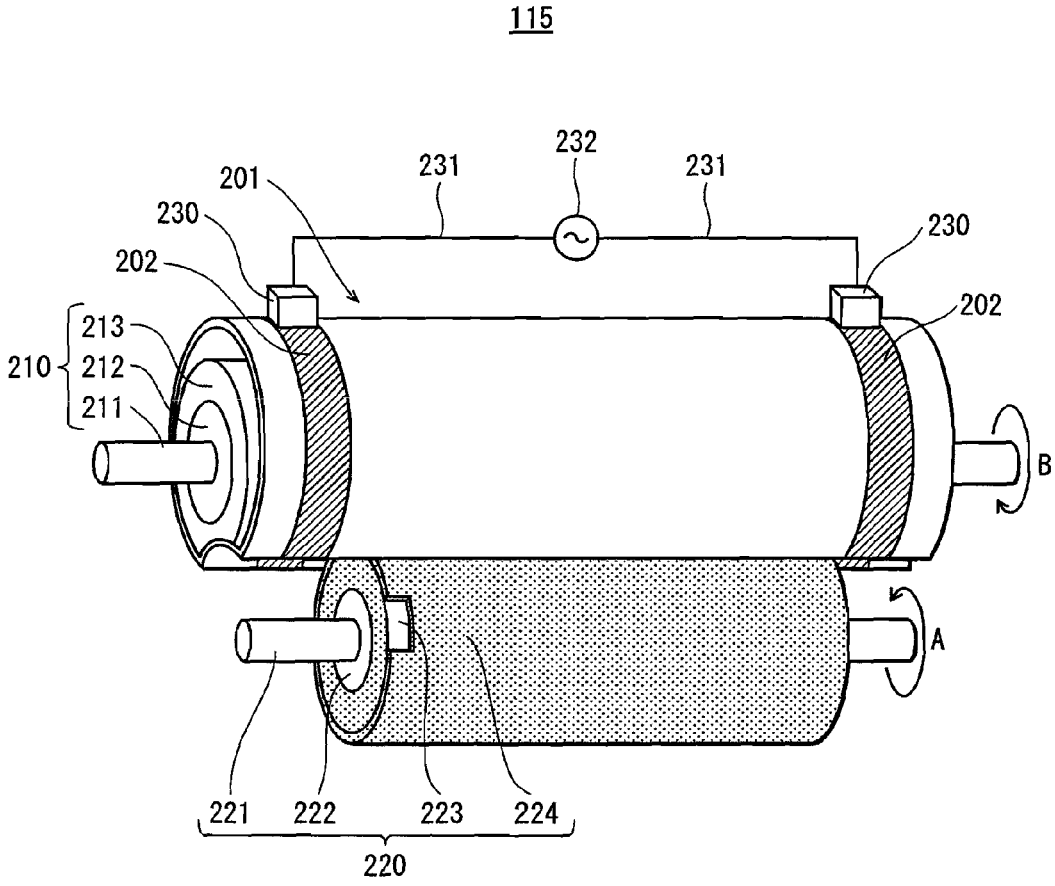
FIG. 2 is a partial cutaway perspective view showing a main structure of a fixing device 115.

FIG. 2 is a partial cutaway perspective view showing a main structure of the fixing device 115. As shown in FIG. 2, the fixing device 115 includes a fixing belt 201, a fixing roller 210, a pressure roller 220, and electric feeders 230. The fixing belt 201 is elastically deformable and endless, and is rotatably wound around the fixing roller 210. The pressure roller 220 is pressed against the fixing roller 210 via the fixing belt 201. The electric feeders 230 supply an electric current to the fixing belt 201 so as to cause the fixing belt 201 to generate heat. Note that FIG. 2 does not show a meander regulation plate for regulating the meandering of the fixing belt 201, so that the structure of the fixing device 115 is easily viewable.

The fixing belt 201 is tubular, and elastically deforms when a certain degree of an external force is applied in a radial direction, but returns from the deformed state to the original state by its restorative force when the application of the external force is stopped. Regarding the dimension of the fixing belt 201 in the radial direction, an inner diameter thereof is 30 mm, for example. The structure of the fixing belt 201 is described later.

The fixing roller 210 is formed by laminating an elastic layer 213 on an outer circumference of a metal core 212 that is elongated. The fixing roller 210 is provided inside a rotation path of the fixing belt 201. Here, the rotation path refers to a path along which the fixing belt 201 is rotated. Hereinafter, the rotation path is referred to as "belt rotation path". The metal core 212 serves as a shaft. The metal core 212 is made of aluminum, stainless steel, or the like, and has a diameter of 18 mm, for example. The elastic layer 213 is made of heat-resistant rubber, such as silicone rubber or fluororubber, or a foamed material obtained by foaming such rubber. Alternatively, the elastic layer 213 may be formed by laminating the heat-resistant rubber and the foamed material. The elastic layer 213 has a thickness of, for example, 5 mm.

An outer diameter of the fixing roller 210 is smaller (e.g., 28 mm) than an inner diameter of the fixing belt 201. The fixing roller 210 is in contact with the fixing belt 201 at a fixing nip N. There is a gap (space) between the fixing roller 210 and the fixing belt 201, in an area excluding the fixing nip N.

According to this structure, the area of the fixing roller 210 where heat from the fixing belt 201 is transferred is smaller than in the case of a structure where the fixing belt 201 is closely in contact with the fixing roller 210 along an entire circumference of the fixing roller 210. This achieves the following advantageous effect. When heat is generated by the fixing belt 201, part of the heat escapes by being transferred, via the metal core 212 of the fixing roller 210, to a housing of the fixing device 115 that rotatably supports the shafts 211 at both ends of the metal core 212. Such a heat transfer loss is reduced, thus realizing high heat efficiency.

The pressure roller 220 is formed by laminating an elastic layer 223 and a release layer 224 in the stated order, on a circumferential surface of a metal core 222 that is elongated. The pressure roller 220 is biased by a bias mechanism (not shown) provided outside the belt rotation path to press the fixing roller 210 via the fixing belt 201. In this way, the fixing nip N is formed between a surface of the pressure roller 220 and a surface of the fixing belt 201. An outer diameter of the pressure roller 220 is preferably in the range of 20 mm to 100 mm inclusive. In the present embodiment, the outer diameter of the pressure roller 220 is 35 mm.

The metal core 222 is hollow pipe-shaped, and is made of aluminum, iron, or the like. An outer diameter of the metal core 222 is, for example, 30 mm. Also, a thickness of the metal core 222 is preferably in the range of 0.1 mm to 10 mm inclusive. In the present embodiment, the thickness of the metal core 777 is 2 mm. Note that the metal core 222 may be solid cylindrical-shaped or have a cross-section that is in the shape of a three-pointed star (i.e., Y-shaped).

The elastic layer 223 is made of, for example, heat-resistant rubber, such as silicone rubber or fluororubber, or a foamed material obtained by foaming such rubber. A thickness of the elastic layer 223 is preferably in the range of 1 mm to 20 mm inclusive. In the present embodiment, the thickness of the elastic layer 223 is 2.5 mm.

The release layer 224 is made of a fluororesin tube or a fluororesin coating that uses PFA (perfluoroalkoxy). The release layer 224 may be conductive so as to prevent the offset phenomenon of toner which is caused by electrostatic charge. Also, a thickness of the release layer 224 is preferably in the range of 5 μm to 100 μm inclusive. In the present embodiment, the thickness of the release layer 224 is 20 μm.

Regarding the fixing roller 210, the shafts 211 at both ends of the metal core 212 in an axis direction thereof are rotatably supported by the housing of the fixing device 115 via bearing members (not shown). Similarly, shafts 221 of the pressure roller 220, which are positioned at both ends of the metal core 222 in an axis direction thereof, are rotatably supported by the housing of the fixing device 115 via bearing members (not shown).

The pressure roller 220 is driven to rotate in a direction of arrow A by the drive force from a drive motor (not shown). Driven by the rotation of the pressure roller 220, the fixing belt 201 and the fixing roller 210 are rotated in a direction of arrow B. Note that the fixing roller 210 may be driven to rotate by the drive force from the drive motor, so that the rotation of the fixing roller 210 causes the fixing belt 201 and the pressure roller 220 to be rotated.

Electrodes 202 are circumferentially provided on an outer circumferential surface of the fixing belt 201, and are close to but apart from the edges of the fixing belt 201 that sandwich a paper-contact region in an axis direction of the fixing roller 210. Also, the electric feeders 230 are pressed against the respective electrodes 202 by a bias force applied from the outside to the inside of the fixing belt 201. A detailed description is provided later.

Each electric feeder 230 is in the shape of a cuboid, and is, for example, 10 mm long, 5 mm wide, and 7 mm tall. Each electric feeder 230 is a so-called carbon brush that is made of copper graphite, carbon graphite, or the like, and is slidable and conductive. The electric feeders 230 are electrically connected to power 232 via conductive wiring (i.e., harness) 231.

Figure 3:
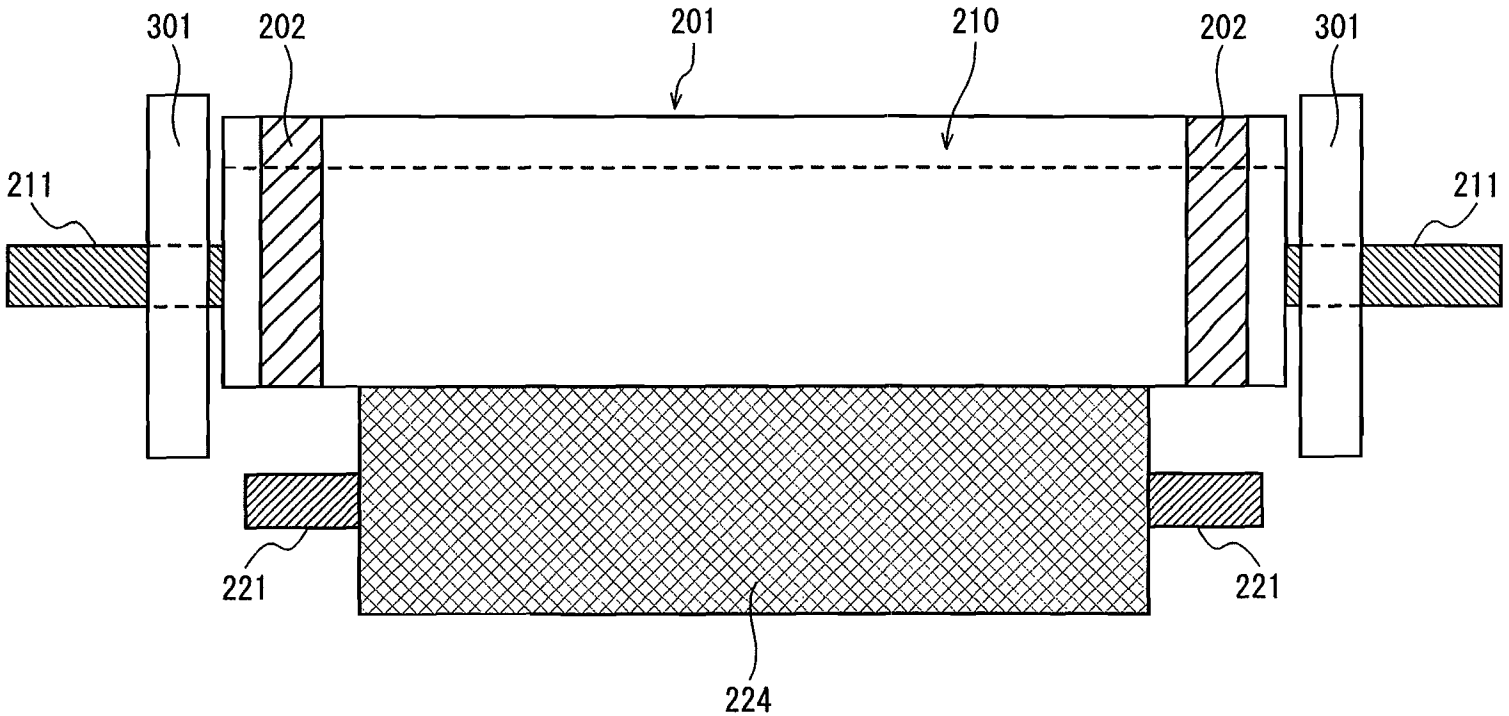
FIG. 3 shows an example of a positional relationship between a fixing belt 201 and meander regulation plates.

FIG. 3 shows an example of a positional relationship between the fixing belt 201 and meander regulation plates. As shown in FIG. 3, meander regulation plates 301 are attached to the respective shafts 211 of the fixing roller 210, which are positioned at edges of the fixing roller 210 in the direction of the rotation axis thereof. The meander regulation plates 301 rotate together with the fixing roller 210, and regulate the meandering of the fixing belt 201.

3. Structure of Fixing Belt 201

The following describes a structure of the fixing belt 201.

Figure 4:
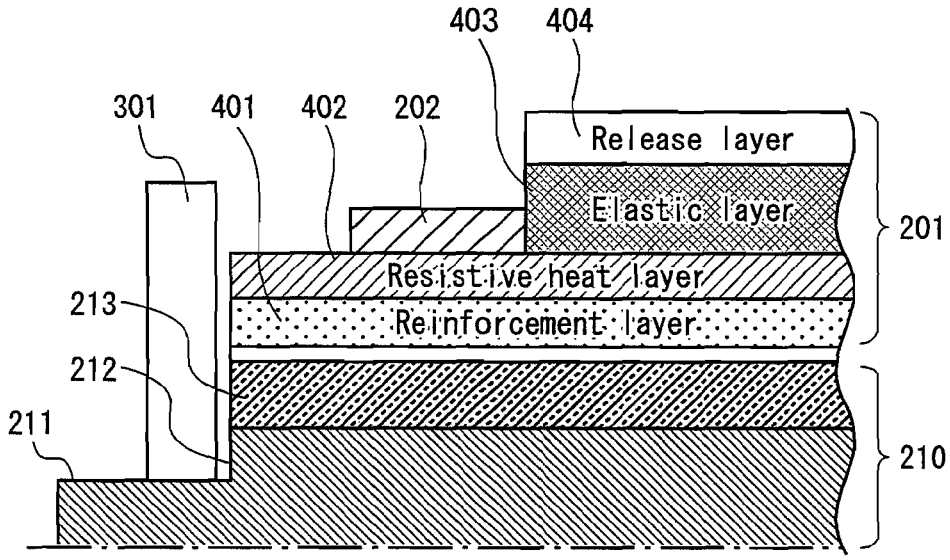
FIG. 4 is a cross-sectional perspective view showing a structure of the fixing belt 201.

FIG. 4 is a cross-sectional perspective view showing the structure of the fixing belt 201. The dashed line in FIG. 4 indicates the center line of the shaft 211. The structure of the fixing belt 201 below the center line is not shown. FIG. 4 only shows an edge of the fixing belt 201 in the direction of the rotation axis thereof. However, the other edge of the fixing belt 201 has the same structure.

As shown in FIG. 4, the fixing belt 201 is formed by successively laminating a resistive heat layer 402, an elastic layer 403, and a release layer 404 in the stated order, on a reinforcement layer 401. Also, the electrode 202 is laminated on the resistive heat layer 402, at an outer side of the elastic layer 403 in the direction of the rotation axis of the fixing roller 210.

The resistive heat layer 402 generates Joule heat by receiving an electric current from the electrode 202. The resistive heat layer 402 is made of resin in which a conductive filler is dispersed, thus having a predetermined electric resistivity. The resin is preferably a heat-resistant resin, such as PI (polyimide), PPS (polyphenylene sulfide), or PEEK (polyether etherketone).

The conductive filler may be metal such as silver (Ag), copper (Cu), aluminum (Al), magnesium (Mg), or nickel (Ni), a carbon-based material such as a carbon nanotube, a carbon nanofiber, or a carbon microcoil, or a mixture of two or more of these metals and materials. The conductive filler is preferably in a fibrous form, so as to increase the probability of filler particles being in contact with each other under the same conditions regarding the content of the conductive filler. A thickness of the conductive filler is preferably in the range of approximately 5 μm to 100 μm. Obviously, the electric resistivity of the conductive filler is determined in accordance with the applied voltage or the applied current, a thickness of the resistive heat layer 402, and a diameter and length of the fixing belt 201. However, it is acceptable as long as the electric resistivity is in the range of $1.0\times10^{-6}$ Ωm to $9.9\times10^{-3}$ Ωm inclusive. It is more preferable that the electric resistivity is in the range of $1.0\times10^{-5}$ Ωm to $5.0\times10^{-3}$ Ωm.

The release layer 404 is preferably made of a fluorine-based coating or a fluorine-based tube such as PFA (tetrafluoroethylene-perfluoro alkylvinyl ether copolymer), PTFE (polytetrafluoroethylene), ETFE (ethylene tetra fluoro ethylene), so that the release layer 404 has releasability. The release layer 404 may be conductive. Examples of the fluorine-based tube include "PFA350-J", "451HP-J", and "951HP Plus", which are products made by Du Pont-Mitsui Fluorochemicals Company, LTD.

It is acceptable as long as a contact angle of the release layer 404 with water is greater than or equal to 90°. However, it is more preferable if the contact angle is greater than or equal to 110°. Regarding a surface roughness of the release layer 404, the center line average roughness (Ra) is preferably in the range of 0.01 μm to 50 μm inclusive. A thickness of the release layer 404 is preferably, for example, in the range of 5 μm to 100 μm inclusive.

For reinforcement and insulation purposes, the release layer 404 may be composed of three or more layers by laminating resin, such as PI or PPS, on an elastic layer made of fluororubber.

The electrodes 202 are circumferentially laminated on portions of the fixing belt 201, each of which is close to but apart from a respective edge of the fixing belt 201 in the direction of the rotation axis of the fixing belt 201. In this way, when an electric current is applied to the electrodes 202, the electric current is uniformly distributed over the resistive heat layer 402. This enables the resistive heat layer 402 to generate heat uniformly.

Also, the electrodes 202 are provided apart from the respective edges of the fixing belt 201. In this way, the electrodes 202 do not directly slide against the meander regulation plates 301, thus preventing a stress from being applied to portions where the electrodes 202 are in contact with the resistive heat layer 402. As a result, the electrodes 202 are prevented from peeling off from the resistive heat layer 402. Note that the electrodes 202 are preferably apart from the respective edges of the fixing belt 201, by a distance greater than or equal to 2 mm.

The electrodes 202 are preferably made of metal having a low electric resistivity, such as gold (Au), silver (Ag), copper, (Cu), aluminum (Al), zinc (Zn), tungsten (W), nickel (Ni), or brass. A process of laminating the electrodes 202 on the resistive heat layer 402 is preferably performed by means of an adhesion method using a conductive adhesive, a plating method, or the like.

The reinforcement layer 401 is made of a heat-resistant insulation resin, such as PI, PPS, or PEEK. A thickness of the reinforcement layer 401 is preferably in the range of 5 μm to 100 μm inclusive. An outer circumferential surface of the reinforcement layer 401 is entirely covered by the resistive heat layer 402.

4. Summarization

As described above, the first electrode is provided closer to the meander regulation member than to the second electrode, and is at a distance from an edge of the fixing belt in the width direction thereof, the edge being adjacent to the meander regulation member. In this way, even if the fixing belt slides against the meander regulation plate, a stress is not easily applied to the first electrode, thus preventing the first electrode from peeling off.

In this case, another meander regulation member may be provided adjacent to another edge of the fixing belt in the width direction thereof. Then, the second electrode may be provided closer to the other meander regulation member than to the first electrode, and may be at a distance from the other edge of the fixing belt in the width direction thereof. Also, the distance between the first electrode and the edge of the fixing belt is preferably greater than or equal to 2 mm.

Furthermore, the fixing belt may further include a reinforcement layer along an entire circumference and an entire width thereof. In this way, the fixing belt is less prone to being deformed. This also prevents a stress, which is caused by the fixing belt sliding against the meander regulation belts, from being applied to the first and second electrodes.

Also, the resistive heat layer and the first electrode may be successively laminated on the reinforcement layer in the stated order, and the resistive heat layer may be shorter in width than the reinforcement layer. In this way, a stress, which is caused by the fixing belt sliding against the meander regulation plates, is not easily applied to the resistive heat layer. This prevents the resistive heat layer from peeling off from the reinforcement layer.

In this case, the distance between the resistive heat layer and the edge of the fixing belt is preferably greater than or equal to 2 mm.

Also, the fixing belt may further include an elastic layer and a release layer, which are successively laminated on the resistive heat layer in the stated order and sandwiched by the first and second electrodes in the width direction of the fixing belt. In this way, even in the case of fixing a color image that requires a large amount of toner, the toner is not easily adhered to the fixing belt, owing to the release layer. This prevents deterioration of images due to the toner from peeling off.

Also, when a surface of the fixing belt is uneven, pressure is not applied uniformly to a toner image. However, with the elastic layer, the uneven surface of the fixing belt is flattened. As a result, pressure is applied uniformly to the toner image, thus preventing undesired variations in fixing the toner image.

Also, the resistive heat layer may be made of a heat-resistant insulating resin in which a conductive filler is dispersed. This enables obtaining a resistive heat layer having an electric resistance suitable for the shape, structure and usage purpose of a fixing device and, by selecting a type of conductive filler, and adjusting the amount of the conductive filler.

Obviously, an image forming apparatus including the fixing device with the aforementioned features also achieves the advantageous effects as described above.

5. Modifications

The present invention has been described based on the above embodiment. However, it goes without saying that the contents of the present invention are not limited to the above embodiment. For example, the following modifications are possible.

(1) In the embodiment described above, the resistive heat layer 402 is laminated on the reinforcement layer 401 in a manner that both edges of the resistive heat layer 402 in the direction of the rotation axis of the fixing belt coincide with both edges of the reinforcement layer 401 in the direction of the rotation axis thereof. However, the present invention is of course not limited to such. For example, the following structure is acceptable.

Figure 5:
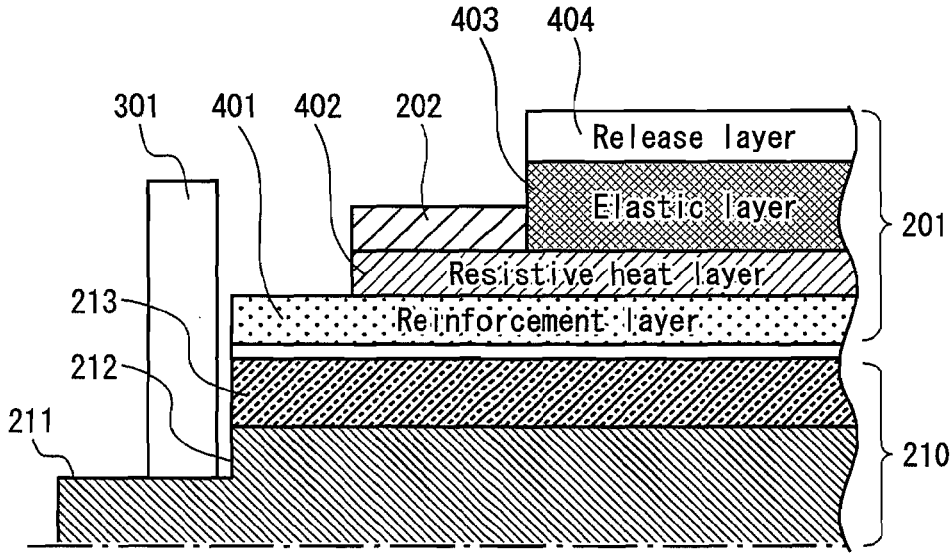
FIG. 5 is a cross-sectional perspective view showing a structure of the fixing belt 201 according to a modification of the present invention.

FIG. 5 is a cross-sectional perspective view showing a structure of the fixing belt 201 according to a modification of the present invention. As shown in FIG. 5, as for the fixing belt 201 according to the present modification, an edge of the resistive heat layer 402 in the direction of the rotation axis thereof does not coincide with an edge of the fixing belt (reinforcement layer 401), but coincides with an edge of the electrode 202. The same applies regarding the other end of resistive heat layer 402 which is not shown. According to this structure, the resistive heat layer 402 does not slide against the meander regulation plate 301 even if an end of the reinforcement layer 401 slides against the meander regulation plate 301.

Since being able to avoid a stress caused by sliding, the resistive heat layer 402 is prevented from peeling off from the reinforcement layer 401. In other words, it is possible to improve durability at a portion where the reinforcement layer 401 is in contact with the resistive heat layer 402. Also, similarly to the above structure, the distance between the resistive heat layer 402 and the edge of the fixing belt 201 is preferably greater than or equal to 2 mm.

Here, an edge of the electrode 202 may not coincide with an edge of the resistive heat layer 402. In this case, even if the reinforcement layer 401 is omitted, the electrode 202 is prevented from peeling off. Needless to say, in the case of omitting the reinforcement layer 401, the resistive heat layer 402 needs to have sufficient strength.

(2) In the embodiment described above, the electrodes 202 are provided apart from the respective edges of the fixing belt 201, in the direction of the rotation axis of the fixing belt 201. However, the present invention is of course not limited to such. For example, the following structure is acceptable when the fixing device 115 includes only one meander regulation plate 301 and it is provided adjacent to an edge of the fixing belt 201 in the direction of the rotational axis thereof.

Figure 6:
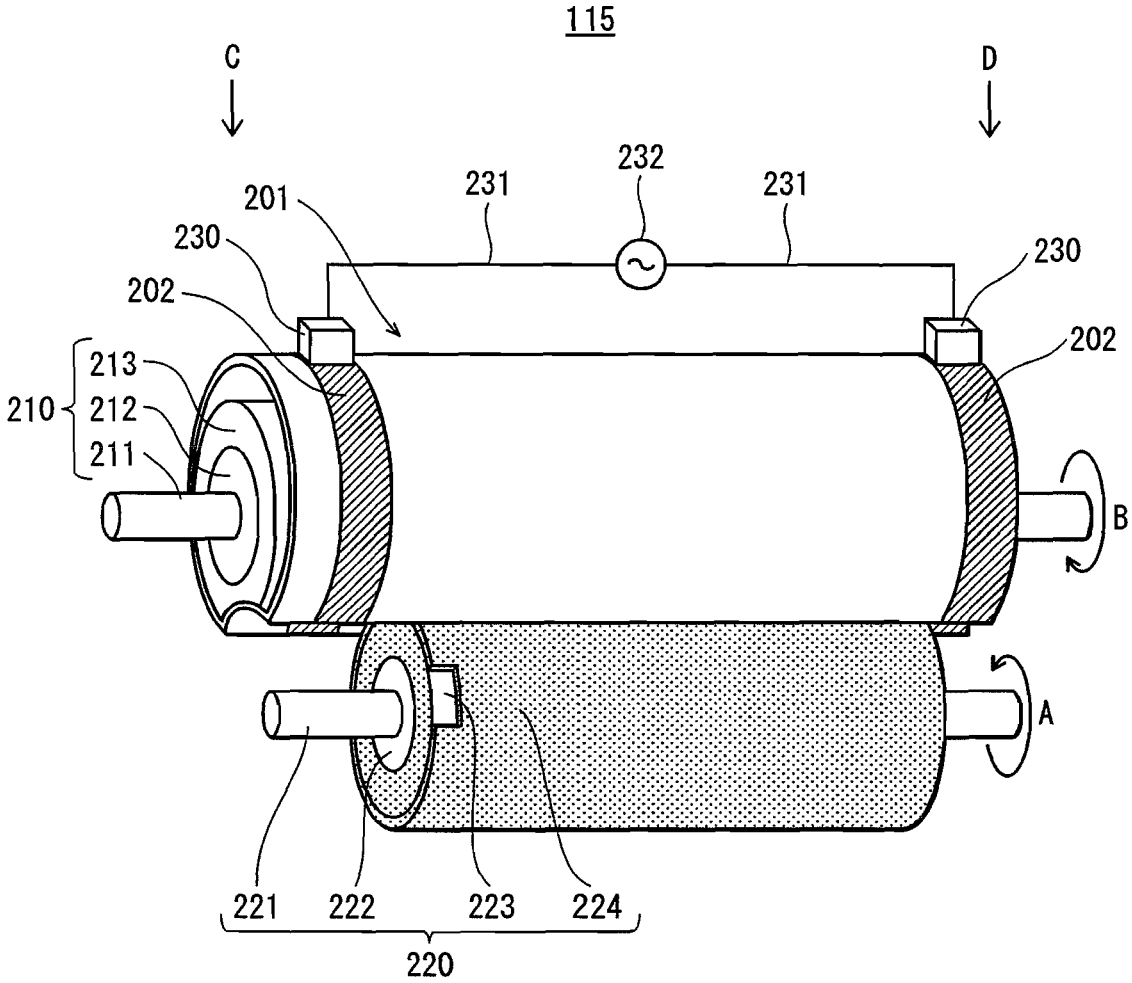
FIG. 6 is a partial cutaway perspective view showing a main structure of the fixing device 115 according to a modification of the present invention.

FIG. 6 is a partial cutaway perspective view showing a main structure of the fixing device 115 according to a modification of the present invention. As shown in FIG. 6, one of the electrodes 202 is provided apart from an edge of the fixing belt 201 indicated by an arrow C, whereas the other one of the electrodes 202 is provided at the other edge of the fixing belt 201 indicated by an arrow D. In this way, only one of the pair of electrodes 202 may be provided apart from the corresponding edge of the fixing belt 201 in the direction of the rotation axis thereof.

In general, when meandering, the fixing belt 201 is likely to deviate to a specific direction along the rotational axis of the fixing belt 201, depending on deviation in assembly or the like. Therefore, it is sufficient that the meander regulation plate 301 is provided adjacent to the fixing belt 201, only in the direction in which the fixing belt 201 deviates so as to regulate the meandering of the fixing belt 201. In such a case, it is not necessary that both of the electrodes 202 are provided apart from the respective edges of the fixing belt 201, in the direction of the rotation axis of the fixing belt 201. The advantageous effect of the present invention is obtained by providing only one of the electrodes 202 that is closer to the meander regulation plate 301, at a distance from the corresponding edge of the fixing belt 201 in the rotational axis thereof.

(3) In the embodiment described above, the fixing belt 201 is rotatably wound around the fixing roller 210. However, the present invention is of course not limited to such. For example, the fixing belt 201 may be rotatably wound around a stationary fixing member instead of the fixing roller 210.

The fixing member may be made of one of the following materials: resin such as polyphenylenesulfide, polyimide or liquid crystal polymer; metal such as aluminum or iron; or ceramics. Alternatively, the fixing member may be made of two materials, i.e., a material such as silicone rubber or fluororubber, and one of the aforementioned materials.

The fixing member must have a shape capable of forming a fixing nip that is sufficient to fuse a toner image onto a recording sheet. Furthermore, in order to reduce friction between the fixing member and the fixing belt 201, the fixing member may be provided with a slide member at a portion that presses against the fixing belt 201. In general, the slide member is made from glass cloth as a base material, and a slide surface thereof is covered by a heat-resistant resin.

(4) In the embodiment described above, the fixing belt 201 and the fixing roller 210 are driven to rotate by the rotation of the pressure roller 220. However, the present invention is of course not limited to such. For example, the following structure is acceptable. That is, the fixing roller 210 may be driven to rotate so as to cause the fixing belt 201 and the pressure roller 220 to be rotated. Alternatively, the fixing roller 210 and the pressure roller 220 may both be driven to rotate so as to cause the fixing belt 201 to be rotated. The advantageous effect of the present invention is equally obtained in any of the structures described above.

(5) The material and size of each member in the above embodiment are merely an example. Even if a different material or a different size is employed, the advantageous effect of the present invention is still obtained as long as the electrodes 202 are apart from the respective edges of the fixing belt 201.

(6) The above embodiment describes, as an example, an image forming apparatus that functions as a tandem-type color copier. However, it is not limited to such. The advantageous effect of the present invention is obtained by any of the following apparatuses that include the fixing device as described above: an image forming apparatus other than a tandem-type image forming apparatus; a monochrome image forming apparatus; a printer; a facsimile; an MFP (Multifunction Peripheral); and the like.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A fixing device for causing a recording sheet, on which an unfixed image has been formed, to pass through a fixing nip, and thermally fixing the unfixed image onto the recording sheet, the fixing device comprising:

a fixing belt that is endless;

a first pressing member provided inside a closed rotation path of the fixing belt;

a second pressing member operable to press the first pressing member from outside the closed rotation path so as to form the fixing nip; and a meander regulation member provided adjacent to an edge of the fixing belt in a width direction thereof, and operable to prevent meandering of the fixing belt, wherein the fixing belt includes:

a resistive heat layer that is tubular and generates heat when an electric current is applied thereto; and first and second electrodes that are provided circumferentially on an outer circumferential surface of the resistive heat layer, and that receive and apply the electric current to the resistive heat layer, and the first electrode is provided closer to the meander regulation member than to the second electrode, and is at a distance from the edge of the fixing belt in the width direction that is greater than or equal to 2 mm.

2. The fixing device of claim 1 further comprising:

another meander regulation member provided adjacent to another edge of the fixing belt in the width direction thereof, and operable to prevent meandering of the fixing belt, wherein the second electrode is provided closer to the other meander regulation member than to the first electrode, and is at a distance from the other edge of the fixing belt in the width direction thereof.

3. The fixing device of claim 1, wherein the fixing belt further includes a reinforcement layer along an entire circumference and an entire width thereof.

4. The fixing device of claim 1, wherein the resistive heat layer is made of a heat-resistant insulating resin in which a conductive filler is dispersed.

5. A fixing device for causing a recording sheet, on which an unfixed image has been formed, to pass through a fixing nip, and thermally fixing the unfixed image onto the recording sheet, the fixing device comprising:

a fixing belt that is endless;

a first pressing member provided inside a closed rotation path of the fixing belt;

a second pressing member operable to press the first pressing member from outside the closed rotation path so as to form the fixing nip; and a meander regulation member provided adjacent to an edge of the fixing belt in a width direction thereof, and operable to prevent meandering of the fixing belt, wherein the fixing belt includes:

a resistive heat layer that is tubular and generates heat when an electric current is applied thereto;

first and second electrodes that are provided circumferentially on an outer circumferential surface of the resistive heat layer, and that receive and apply the electric current to the resistive heat layer, and the first electrode is provided closer to the meander regulation member than to the second electrode, and is at a distance from the edge of the fixing belt in the width direction thereof; and a reinforcement layer along an entire circumference and an entire width thereof, wherein the resistive heat layer and the first electrode are successively laminated on the reinforcement layer in a stated order, and the resistive heat layer is shorter in width than the reinforcement layer.

6. The fixing device of claim 5, wherein the distance between the resistive heat layer and the edge of the fixing belt is greater than or equal to 2 mm.

7. The fixing device of claim 5, wherein the fixing belt further includes an elastic layer and a release layer, and the elastic layer and the release layer are successively laminated on the resistive heat layer in a stated order, and sandwiched by the first and second electrodes in the width direction of the fixing belt.

8. An image forming apparatus including a fixing device for causing a recording sheet, on which an unfixed image has been formed, to pass through a fixing nip, and thermally fixing the unfixed image onto the recording sheet, the fixing device comprising:

a fixing belt that is endless;

a first pressing member provided inside a closed rotation path of the fixing belt;

a second pressing member operable to press the first pressing member from outside the closed rotation path so as to form the fixing nip; and a meander regulation member provided adjacent to an edge of the fixing belt in a width direction thereof, and operable to prevent meandering of the fixing belt, wherein the fixing belt includes:

a resistive heat layer that is tubular and generates heat when an electric current is applied thereto; and first and second electrodes that are provided circumferentially on an outer circumferential surface of the resistive heat layer, and that receive and apply the electric current to the resistive heat layer, and the first electrode is provided closer to the meander regulation member than to the second electrode, and is at a distance from the edge of the fixing belt in the width direction that is greater than or equal to 2 mm.

9. The image forming apparatus of claim 8, wherein the fixing device further comprising:

another meander regulation member provided adjacent to another edge of the fixing belt in the width direction thereof, and operable to prevent meandering of the fixing belt, and the second electrode is provided closer to the other meander regulation member than to the first electrode, and is at a distance from the other edge of the fixing belt in the width direction thereof.

10. The image forming apparatus of claim 8, wherein the fixing belt further includes a reinforcement layer along an entire circumference and an entire width thereof.

11. The image forming apparatus of claim 8, wherein the resistive heat layer is made of a heat-resistant insulating resin in which a conductive filler is dispersed.

12. An image forming apparatus including a fixing device for causing a recording sheet, on which an unfixed image has been formed, to pass through a fixing nip, and thermally fixing the unfixed image onto the recording sheet, the fixing device comprising:

a fixing belt that is endless;

a first pressing member provided inside a closed rotation path of the fixing belt;

a second pressing member operable to press the first pressing member from outside the closed rotation path so as to form the fixing nip; and a meander regulation member provided adjacent to an edge of the fixing belt in a width direction thereof, and operable to prevent meandering of the fixing belt, wherein the fixing belt includes:

a resistive heat layer that is tubular and generates heat when an electric current is applied thereto;

first and second electrodes that are provided circumferentially on an outer circumferential surface of the resistive heat layer, and that receive and apply the electric current to the resistive heat layer, and the first electrode is provided closer to the meander regulation member than to the second electrode, and is at a distance from the edge of the fixing belt in the width direction thereof; and a reinforcement layer along an entire circumference and an entire width thereof, wherein the resistive heat layer and the first electrode are successively laminated on the reinforcement layer in a stated order, and the resistive heat layer is shorter in width than the reinforcement layer.

13. The image forming apparatus of claim 12, wherein the distance between the resistive heat layer and the edge of the fixing belt is greater than or equal to 2 mm.

14. The image forming apparatus of claim 12, wherein the fixing belt further includes an elastic layer and a release layer, and the elastic layer and the release layer are successively laminated on the resistive heat layer in a stated order, and sandwiched by the first and second electrodes in the width direction of the fixing belt.

* * * * *